United States Patent [19]

Bond

[11] 4,372,375

[45] Feb. 8, 1983

[54] HEAT EXCHANGER

[75] Inventor: Michael P. Bond, Crawley, England

[73] Assignee: The A.P.V. Company Limited, Crawley, England

[21] Appl. No.: 169,132

[22] Filed: Jul. 15, 1980

[30] Foreign Application Priority Data

Aug. 8, 1979 [GB] United Kingdom ..... 7927611

[51] Int. Cl.[3] ..... F28F 3/00

[52] U.S. Cl. ..... 165/70; 165/167

[58] Field of Search ..... 165/70, 167

[56] References Cited

U.S. PATENT DOCUMENTS

| | | | |
|---|---|---|---|
| 2,193,405 | 3/1940 | Goodman | 165/167 |
| 3,908,757 | 9/1975 | Wright | 165/167 |
| 4,252,182 | 2/1981 | Fender | 165/70 |

FOREIGN PATENT DOCUMENTS

| | | | |
|---|---|---|---|
| 1019319 | 10/1977 | Canada | 165/70 |
| 1393621 | 5/1975 | United Kingdom | 165/167 |

*Primary Examiner*—William B. Cline
*Assistant Examiner*—Theophil W. Streule, Jr.
*Attorney, Agent, or Firm*—Christel, Bean & Linihan

[57] ABSTRACT

When plate heat exchangers are used with hazardous fluids the gasketing at the periphery may be replaced by welding the plates in pairs, with elastomeric gaskets between adjacent packs of plates. However, it is still necessary to have a gasket around the through holes (6) for the hazardous medium to seal them from the other medium. In accordance with the present invention, these gaskets are of duplex form (8, 9) with a sealed space (11) between the gasketing. In order to detect leakage into the sealed space a diluent fluid may be circulated through the sealed spaces and a detector, refer to FIG. 2.

4 Claims, 4 Drawing Figures

HEAT EXCHANGER

This invention relates to plate heat exchangers.

A plate heat exchanger consists essentially of a pack of plates arranged in face to face relationship to form flow spaces between adjacent plates. Ports for the supply and discharge of heat exchange media to the flow spaces are formed by aligned holes in the plates and gaskets or other seals control the communication between the ports and the flow spaces and peripheral gaskets or seals define the edges of the flow spaces. Normally, rubber or other elastomeric material is used for the gaskets, but this limits the use of the plate heat exchanger as the elastomer may be subject to corrosive attack. A principal advantage of the use of elastomeric gaskets is that the pack may be easily opened up for inspection and cleaning and replacement of plates or gaskets is quite simple.

If the use of elastomeric gaskets is to be avoided, recourse may be had to welding the plates together to form the required seals, but the ease of inspection and operational flexibility associated with separable packs of plates are then lost. Also, if a weld should be or become faulty, so that the seal is lost, it may be difficult to detect and repair, particularly if the defective weld is at an inaccessible point. In these circumstances scrapping of the whole pack of plates might become necessary.

It has previously been proposed to provide a plate heat exchanger in which adjacent plates forming the flow spaces for one heat exchange medium are welded together in pairs around the peripheries of the plates, whereas the flow spaces for the other medium are sealed by elastomeric gaskets.

Such plates are welded together round the through-holes forming the port carrying the other medium through the welded pairs of plates. Provision is also made for the use of corrosion-resistant gaskets to separate the two media.

Such exchangers using welded pairs of plates are particularly useful for corrosive or otherwise hazardous fluids, so that generally passages for the hazardous medium are bounded by welds rather than the more fallible gasketing but the use of gaskets cannot be avoided if the heat exchanger is to be capable of being opened up so that some gasketing in contact with the hazardous medium is necessary.

According to the present invention, there is provided a plate heat exchanger wherein adjacent plates forming the flow spaces for one heat exchange medium are welded together in pairs around the peripheries of the plates and around the through holes forming the ports carrying the other medium through the welded pairs of plates, whereas the flow spaces for the other medium are sealed by flexible gaskets, in which the through holes forming the ports for the said one medium are sealed from the flow spaces for the other medium and from the ambient space by a duplex gasket arrangement with a sealed space between the gasketing.

Thus, any of the hazardous medium has to pass two failed gaskets to reach the ambient atmosphere and normally there would have to be a triple gasket failure for the media to mix, as there is normally a vented space between a port gasket and the peripheral gasket of the flow space for other medium.

Preferably, the said sealed space is provided with means for detecting the presence of the said one medium so that incipient failure can be detected before the hazardous medium reaches the atmosphere or the other medium.

The invention will be further described with reference to the accompanying diagrammatic drawings, in which.

Figure 1:
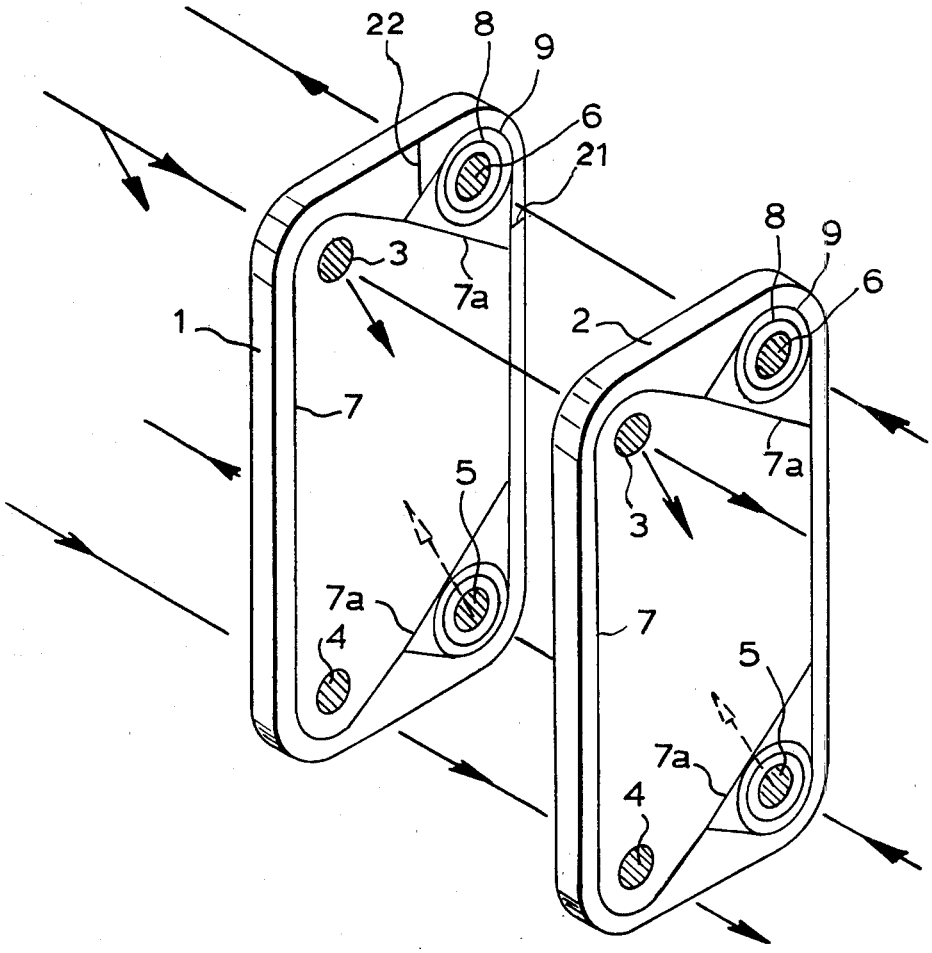
FIG. 1 is an exploded perspective view of two successive pairs of welded plates in a heat exchanger according to one form of the invention.

FIG. 1 shows two successive pairs of plates 1 and 2 respectively, each pair consisting of a pair of heat exchanger plates, the details of which have largely been omitted for clarity of illustration and to avoid detracting from the generality of the present invention. The plates are welded up along their peripheries, instead of using peripheral gaskets to seal the flow space formed between them. Also, welding up is carried out around the ports 3 and 4 which carry the medium which does not enter between the plates. This may be deemed to be the non-hazardous or safe medium. For the sake of description, it will be assumed that the safe medium is fed in via ports formed by the holes 3 and withdrawn via the ports formed by the holes 4. On the other hand, the hazardous medium, such as ammonia, is fed in via ports formed by holes 5 and out via ports formed by holes 6. The flow spaces for the hazardous medium are totally within the welded-up pairs and the flow spaces for the safe medium are defined between adjacent welded up pairs. A peripheral gasket 7 is shown on each pair 1 and 2 to define the periphery of this flow space. In addition to a portion, marked *7a*, of the gasket 7, the holes 5 and 6 are isolated from the flow space for the safe medium by gasketing around the holes themselves.

This gasketing must be of such material as to resist corrosive attack by the hazardous medium.

Figure 2:
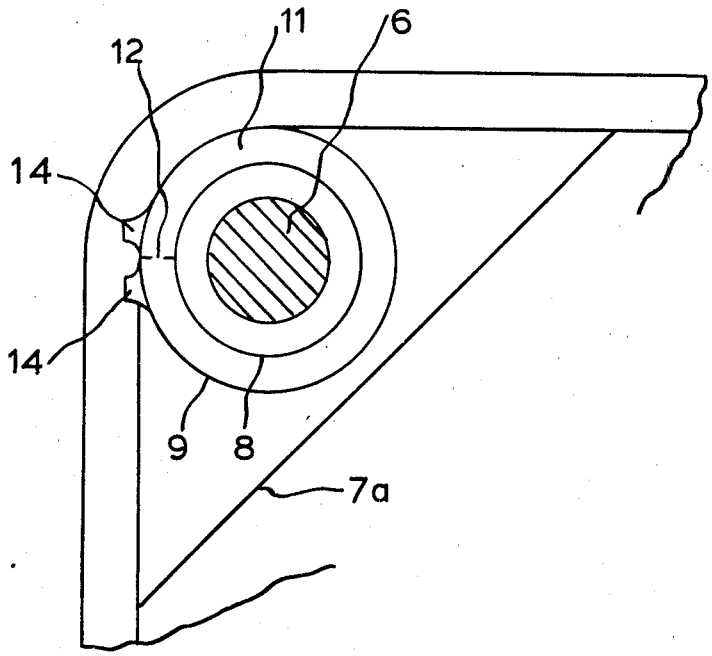
FIG. 2 is an elevational view of one port and the associated gasketing.
Figure 3:
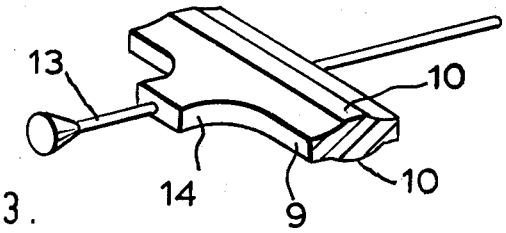
FIG. 3 is a perspective view of a detail.

However, in order to provide a greater degree of safety, this gasketing is now duplicated so as to consist of inner gasket 8 and an outer gasket 9. Reference should also be made of FIG. 2. In FIGS. 1 and 2, the gasketing is shown only as a line, but it will be appreciated that in fact the gasketing is a fairly thick body, normally of an elastomeric or appropriate corrosion-resistant material flexible enough to serve the required purpose. A typical cross-section of a gasket can be seen in FIG. 3 wherein a length of the gasket 9 is illustrated and it will be seen it has peak zones 10 on the upper and lower surfaces.

Between the inner and outer gaskets 9 there is a sealed space 11, and it will also be seen that between the gasket 9 and the gasket portion *7a* there is a further space which is normally vented as indicated at 21 and 22 in FIG. 1 in respect of the pair 1 of plates.

Thus, it will be seen that the hazardous medium flowing through the port formed by the holes 6 has to pass the inner gasket 8, through the sealed space 11 and the outer gasket 9 before it can reach atmosphere, and therefore there has to be a double gasket failure. Further, in order for the hazardous medium to mix with the safe medium, which could lead to potentially dangerous chemical reaction, a third gasket, namely the gasket length *7a* also has to fail. Accordingly, the system is inherently very safe.

Figure 4:
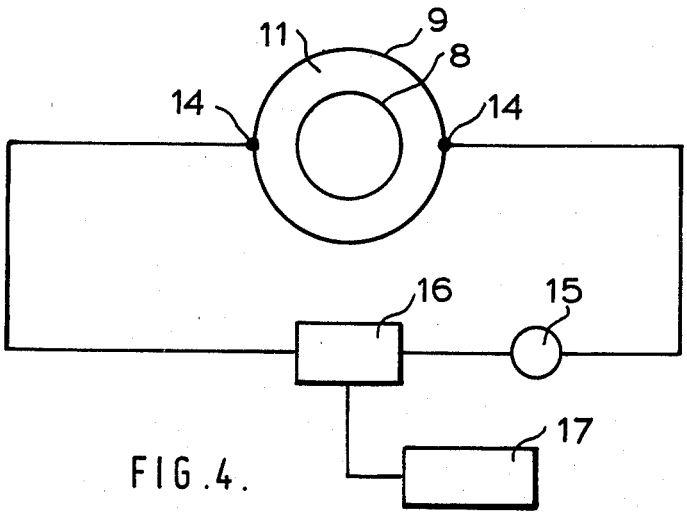
FIG. 4 is a circuit diagram of a detector circuit.

In addition, in order to detect incipient failure, the outer gasket 9 may be provided with connections to the sealed space 11, e.g. micro-bore piping 13 passing through widened portions 14 of the gasket 9, so that a suitable diluent fluid may be pumped continuously, by means of a pump 15 (see FIG. 4) arranged in closed circuit with the connections through the portions 14 and the sealed space 11. Also in the circuit is a detector which may detect the presence in the sealed space of either the hazardous medium, which would indicate failure of the gasket 8, or, possibly, pressure changes resulting from failure of the gasket 9. The detector is illustrated at 16 and is arranged to operate a warning system indicated generally by 17 in FIG. 4.

In order to ensure that the whole of the space 11 is swept by the liquid or gas pumped through by the pump 15, in cases where the entry and exit connections are close together, a flow restriction as indicated at 12 may be provided in the region of the connections 14.

Various modifications may be made within the scope of the invention.

I claim:

1. In a plate heat exchanger wherein adjacent plates forming the flow spaces for one heat exchange medium are welded together in pairs around the peripheries of the plates and around the through holes forming the ports carrying the other medium through the welded pairs of plates, whereas the flow spaces for the other medium are sealed by flexible gaskets: the improvement that the through holes forming the ports for the said one medium are sealed from the flow spaces for the other medium and from the ambient space by a duplex gasket arrangement with a sealed space between the gasketing.

2. A plate heat exchanger as claimed in claim 1, wherein the sealed space is provided with means for detecting the presence of the said one medium so that incipient failure can be detected before the hazardous medium reaches the atmosphere or the other medium.

3. A plate heat exchanger as claimed in claim 2, in which means is provided for pumping a diluent fluid continuously through the sealed space and through a detector.

4. A plate heat exchanger as claimed in claim 3, in which a flow restriction is provided in the sealed space to ensure that it is fully swept by the diluent fluid.

* * * * *